US006971896B2

(12) United States Patent
Bartley et al.

(10) Patent No.: US 6,971,896 B2
(45) Date of Patent: Dec. 6, 2005

(54) FLEX STRIPS FOR HIGH FREQUENCY CONNECTORS

(75) Inventors: Gerald Keith Bartley, Rochester, MN (US); Richard Boyd Ericson, Rochester, MN (US); Wesley David Martin, Elgin, MN (US); Benjamin William Mashak, Rochester, MN (US); Trevor Joseph Timpane, Rochester, MN (US); Ay Vang, Vadnais Heights, MN (US)

(73) Assignee: International Business Machines Corporaion, Armonk, NY (US)

( * ) Notice: Subject to any disclaimer, the term of this patent is extended or adjusted under 35 U.S.C. 154(b) by 0 days.

(21) Appl. No.: 10/753,521

(22) Filed: Jan. 8, 2004

(65) Prior Publication Data

US 2005/0153584 A1 Jul. 14, 2005

(51) Int. Cl.[7] ..... H01R 4/60
(52) U.S. Cl. ..... 439/215
(58) Field of Search ..... 439/215, 502, 439/497; 174/117 FF

(56) References Cited

U.S. PATENT DOCUMENTS 3,092,805 A * 6/1963 Koeijmans ..... 367/50
4,552,420 A * 11/1985 Eigenbrode ..... 439/67
4,875,871 A * 10/1989 Booty et al. ..... 439/209
5,244,410 A * 9/1993 Demus et al. ..... 439/497
5,267,868 A * 12/1993 Wolff, Jr. ..... 439/95
5,573,409 A * 11/1996 Shiley et al. ..... 439/76.1
6,081,728 A * 6/2000 Stein et al. ..... 455/523
6,126,453 A * 10/2000 Gomez et al. ..... 439/63

* cited by examiner

*Primary Examiner*—Phuong Dinh
(74) *Attorney, Agent, or Firm*—Robert W. Lahtinen

(57) ABSTRACT

A high frequency connector utilizes flex strip signal/reference conductor pairs extending in channels formed in a dielectric connector body between terminations at connector ends. The flex strips are formed as signal and reference conductor traces separated by a flexible dielectric wherein the impedance can be influenced by the width of the signal and reference traces and the thickness and selected material of the dielectric separating the adjoining conductor traces. Design of the flex strip assemblies is used to vary the capacitance which enables the connector impedance to match the impedance of the circuits and/or cables connected to the connector and mitigate any discontinuities among the sequence of circuit paths. The close proximity of signal and reference traces within the pair and the separation of signal lines in the connector body reduces cross talk by minimizing mutual inductance between signal lines.

6 Claims, 1 Drawing Sheet

FLEX STRIPS FOR HIGH FREQUENCY CONNECTORS

FIELD OF THE INVENTION

The present invention relates to electrical connectors and more particularly to electrical connectors for carrying high frequency signals.

BACKGROUND OF THE INVENTION

Current state of the art electronic devices rely on the transmission of high frequency signals between physically separated circuits. This can be difficult because of the susceptibility of such signals to various adverse influences that compromise bandwidth, the amount of information transmitted per unit of time. Reduction or elimination of signal degradation is desirable or necessary since the information processing capability of modern electrical circuits exceeds the frequencies which can be reliably handled by the cables and connectors that interconnect physically separated circuits. Connectors must provide electronic characteristics comparable to the electronic characteristics of the circuits being connected to assure that signal quality is maintained through the connector.

The quality of high frequency signals transmitted between circuits through a connector can be compromised or degraded by the magnitude of reflected signals due to the interface between conduction paths of the connected circuits and the conductive traces of the connector. Another major source of signal degradation is crosstalk, the interference to a signal carried by one electrical path caused by a signal on an adjacent path. Crosstalk interference results from the inductive and or capacitive coupling that occurs between electrically conductive paths. Current solutions to crosstalk problems include the use of multiple ground pins surrounding and separating signal pins. Some connectors also use solid wires that vary in length depending on the size and number of rows of the conductor which can make the signal and return paths unequal.

SUMMARY OF THE INVENTION

The high frequency connector of the present invention replaces the conductor wires with flex strip signal/reference conductor pairs within channels through a dielectric connector body. The electrical characteristics of the flex strip signal/reference conductors can be modified to achieve the needs of the connector design. The ability to create a desired impedance of the flex strip conductor pair enables the impedance of the connector to be matched to the impedance of the connected high frequency circuits and signal transmission lines to minimize discontinuities and signal degradation. "High Frequency" in the context of this specification means that signal rise and fall times are shorter than a time needed to propagate the rise times or the fall times from a beginning of a conducting path to an end of the conducting path.

The flex strip application also reduces crosstalk between adjoining signals by the closely proximate disposition of signal and reference traces and the significantly larger dielectric separation of adjacent signal traces which significantly reduces inductive coupling within the connector.

The close proximity of the reference trace to the paired signal trace reduces the effective radiating loop area and the electromagnetic interference associated therewith. A further advantage of the flex strip signal/reference pair connector is the ability to individually match the flex strip conductors to the attached circuitry to adapt each connector conductor to the specific impedance requirements of the attached high frequency circuit.

DETAILED DESCRIPTION

Figure 1:
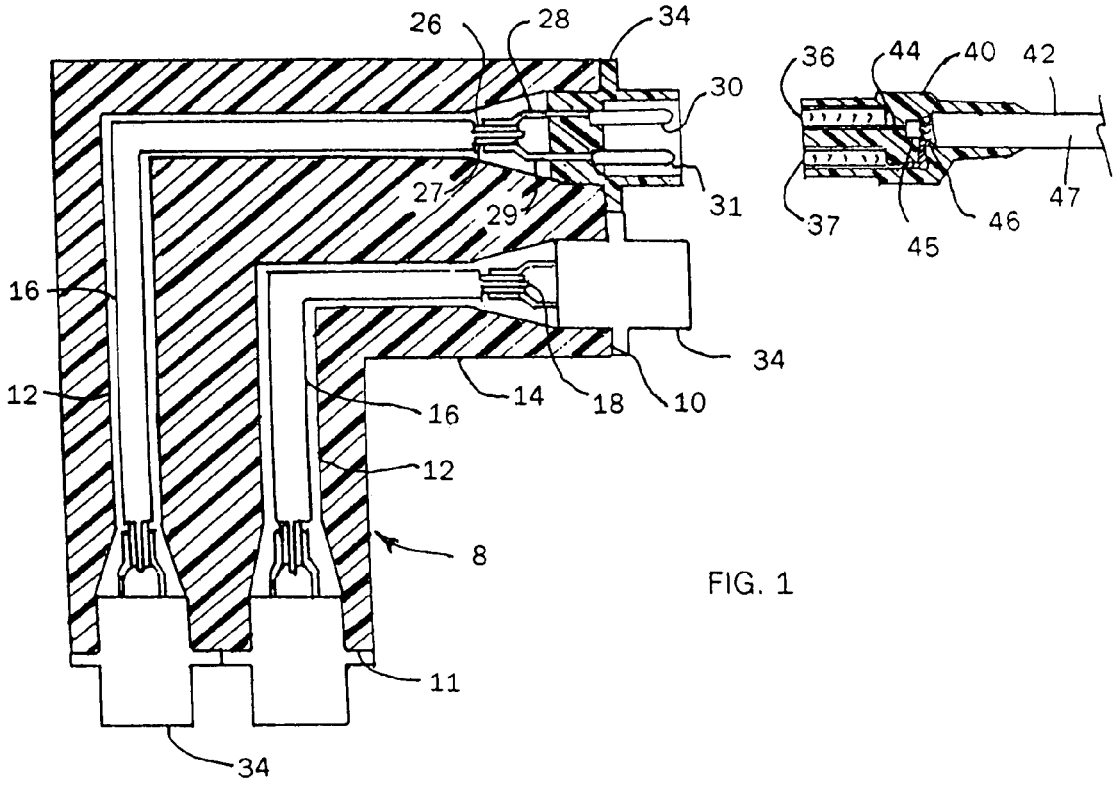
FIG. 1 is a section view of the connector of the present invention taken through a pair of conductor channels which carry signal/reference trace pairs through the connector and further shows the sectional detail of one connector attachment portion and a cooperating terminal end portion of a coaxial cable.
Figure 2:
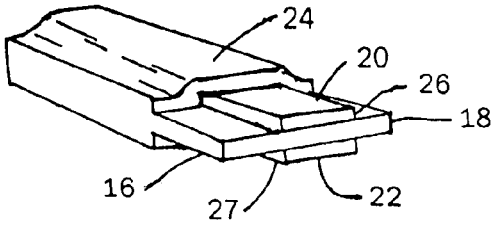
FIG. 2 is a detail end view of a flex strip signal/reference pair with the exposed trace connection portions as used in the connector of FIG. 1.

FIG. 1 illustrates a high frequency connector 8 incorporating the present invention. Although the connector 8 may be of any configuration, the example shown and described is a right angle connector. The connector 8 has high frequency conductors terminating at connector ends 10 and 11 and disposed in channels 12 extending through a connector body 14 of rigid dielectric material from connector end 10 to connector end 11. The conductive paths, in the form of flex strip signal/reference pairs 16, within the connector 8 utilize flex cable technology wherein, as shown in FIG. 2, a layer of flexible dielectric material 18 separates a signal trace 20 and a reference trace 22. The reference trace is most commonly at ground potential, but may be any reference voltage or a complementary signal. The two conductor traces are covered by a layer 24 of dielectric material.

The connector 8 has terminations at the flex strip conductor ends which are shown as terminal portions adapted to connect to a coaxial cable. The flex strip signal/reference pairs have, at each end, exposed portions 26 and 27 of the signal and reference traces respectively which are connected by conductors 28 and 29 to pins 30 and 31 in the attachment portion 34. The pins 30 and 31 of the connector attachment portions 34 are received in crimped socket portions 36 and 37 supported within the cable attachment portion 40. The coaxial cable 42 has a signal wire 44 surrounded by and separated from a braided shielding conductor 46 by a layer of insulation 45. The cable has at the exterior, an electrically insulating cover 47. The signal wire 44 is electrically connected to the crimped socket 36 and the braided shielding conductor 46 is electrically connected to the crimped socket 37. Although the connector 8 has been shown and described in an environment using coaxial cable attachment portions, various modes of attachment may be used to implement the connector electrical connections to high frequency circuits, such as surface mount or other common attachment techniques.

The flex strip signal/reference pair conductor members 16 are designed to cause the impedance to match the impedance of the connected circuits. The flex strip impedance is controlled by the size and separation of the signal trace and the ground trace. The flex circuit conductors may have traces of equal width, as shown in FIG. 2 or may be varied to produce the desired impedance. The design may also utilize the selection of the dielectric material in addition to the separation between traces.

The flex strip connector design reduces crosstalk between multiple signal traces within the connector. The signal trace and reference trace of each pair closely adjoin one another compared to the separation of adjacent signals imposed by the connector body 14 between the flex strip conductor carrying channels 12 extending therethrough. The close proximity of the signal trace to the ground trace and the separation of the adjoining signal traces within the connector body minimizes the mutual inductance and consequently, the crosstalk between adjacent signal traces. The closely spaced signal and reference traces also enable the returning signal current to be close to the outgoing signal path such that the magnetic fields from the outgoing and return paths cancel to minimize electromagnetic interference.

In an alternative embodiment of the invention, the conductive paths, in the form of flex strip signal reference pairs 16 within connector 8 utilize flex cable technology wherein, signal trace 20 and reference trace 22 are disposed on the same side of dielectric material 18 and have geometries and spacing suitable to establish a desired impedance.

Another advantage that can be realized using the present invention is the ability to match various signal lines of the connector to different impedances. Since the signal traces are on individual flex circuits, each can be matched to a specific signal line despite the fact that some or all lines must be matched to a different impedance.

The foregoing description of an embodiment of the invention has been presented for purposed of illustration and description. It is not intended to be exhaustive or limit the invention to the precise form disclosed. Many modifications and variations are possible in light of the above teaching. For example, not only may many forms of termination and attachment be implemented between the connector and the attached circuits, but also the invention may be utilized in other environments such as those using differential signals wherein a true phase and a complementary phase form a differential signal and are disposed on opposite sides of the flex strip. It is intended that the scope of the invention be limited not by the description and illustrations, but rather by the claims appended hereto.

What is claimed is:

1. An electrical connector for interconnecting a plurality of high frequency signals from a first end of said connector to a second end of said connector comprising:

a connector body of rigid dielectric material having a plurality of passageways each extending from said first connector end to said second connector end; and a plurality of conductor members each respectively positioned in one of said plurality of passageways and extending between said first connector end and said second connector end;

each said conductor member comprising a continuous strip of uniform thickness flexible dielectric material extending from said first connector end to said second connector end and first and second conductive traces positioned respectively along, formed on opposite surfaces, and separated by the thickness of said strip of flexible dielectric material which extend from said first connector end to said second connector end.

2. The electrical connector of claim 1 wherein said first conductive trace is a signal trace and said second conductive trace is a reference trace.

3. The electrical connector of claim 2 wherein said connector interconnects high frequency circuits and each of said conductor members is designed with the widths of said signal trace and said reference trace and the thickness of the dielectric separating said signal and reference traces selected to produce an impedance that matches the impedance of a high frequency circuit connected thereto.

4. The electrical connector of claim 3 wherein said reference traces are ground traces.

5. The electrical connector of claim 3 wherein each said signal trace is a true phase of a differential signal and each said reference trace is a complimentary phase of the associated differential signal.

6. The electrical connector of claim 3 wherein at least one of said plurality of conductor members has an impedance differing from the impedance of others of said plurality of conductor members to match high frequency circuits having differing impedances.

* * * * *